US006329115B1

(12) United States Patent
Yamashita

(10) Patent No.: US 6,329,115 B1
(45) **Date of Patent: *Dec. 11, 2001**

(54) TONER FOR USE IN ELECTROPHOTOGRAPHY AND METHOD OF PRODUCING THE SAME

(75) Inventor: Hiroshi Yamashita, Shizuoka (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/927,544

(22) Filed: Sep. 11, 1997

(30) Foreign Application Priority Data

Sep. 11, 1996 (JP) ..... 8-240428
Sep. 10, 1997 (JP) ..... 9-245413

(51) Int. Cl.[7] ..... G03G 9/08
(52) U.S. Cl. ..... 430/111; 430/110; 430/137
(58) Field of Search ..... 430/111, 110, 430/109, 137

(56) References Cited

U.S. PATENT DOCUMENTS 4,853,311 * 8/1989 Tavernier et al. ..... 430/109
4,996,126 * 2/1991 Anno et al. ..... 430/109
5,305,061 * 4/1994 Takama et al. ..... 430/111
5,422,707 * 6/1995 Takiguchi et al. ..... 430/109
5,738,965 * 4/1998 Nakadera et al. ..... 430/109
5,805,969 * 9/1998 Elsermans et al. ..... 430/126

OTHER PUBLICATIONS

Schaffert, R. M. Electrophotography. New York: John Wiley & Sons. pp. 557–561. 1975.*

* cited by examiner

*Primary Examiner*—Christopher D. RoDee
(74) *Attorney, Agent, or Firm*—Oblon, Spivak, McClelland, Maier & Neustadt, P.C.

(57) ABSTRACT

A toner for use in electrophotography has toner particles, each toner particle containing a resin, a colorant, a fluidity-imparting agent and a volatile organic component which is in an amount of 100 ppm or less per unit amount of the toner particles, and having an average spherical degree in a range of 100 to 150. In addition, the above-mentioned toner is produced by preparing primary particles, each particle including a resin and a colorant, depositing a fluidity-imparting agent on the surface of the primary particles, dispersing the fluidity-imparting agent deposited primary particles in a liquid containing a dispersant, in which liquid the resin is insoluble, thereby preparing a dispersion of the primary particles, heating the dispersion with stirring, and cooling the dispersion, thereby obtaining toner particles for use in the toner.

12 Claims, 3 Drawing Sheets

TONER FOR USE IN ELECTROPHOTOGRAPHY AND METHOD OF PRODUCING THE SAME

BACKGROUND OF THE INVENTION

1. Field of the Invention

The present invention relates to a toner for use in electrophotography, which is capable of producing high quality images with high resolution, and the method of producing such a toner.

2. Discussion of Background

In recent years, in line with the image formation by digital system of the electrophotographic process, a developer is required to reproduce high quality images. In addition, there are many chances of outputting digital images by use of a computer, digital camera, and scanner, and full-color copying machines and printers for producing hard copy of a full-color image have been widely utilized. Further, with respect to the computer for home or office use, many trials have been made to make such equipment compact, drop the manufacturing cost, and minimize waste products so as to increase the recyclability.

The toner for image formation in the electrophotographic process is conventionally prepared by pulverizing a mass comprising a resin and a colorant in a stream at high revolution, and separating the particles with desired particles size by classification. According to the above-mentioned conventional method, the particle diameter of the toner particles is controlled to be as small as possible, and the particle size distribution thereof is controlled to be as narrow as possible for improving the quality of the obtained toner image. However, the shape of the toner particles prepared by the above-mentioned pulverizing method is amorphous. Therefore, the toner particles thus obtained by the pulverizing method tend to be easily broken to pieces by the application of stress thereto. To be more specific, when such conventional toner particles are employed for a two-component developer, the toner particles are easily broken while stirring with a carrier in a developing unit. In the case of a one-component developer, the toner particles are also easily broken when coming in contact with a toner-layer-thickness regulator or a triboelectric charging blade. The thus generated finely-divided pieces of toner particles will lower the image quality of obtained toner images.

Further, the fluidity of the toner particles thus prepared by the pulverizing method is poor because they are amorphous in shape, so that a large quantity of fluidity-imparting agent is required. In addition, because of the amorphous shape, the packing of toner particles in a toner bottle is lowered, thereby preventing the equipment from being made compact.

For the formation of a full-color image, a full-color toner image formed on the surface of a photoconductor is transferred to an intermediate image transfer member and a sheet of paper. As mentioned above, the image transfer step becomes very complicated when a full-color toner is employed. In addition, the transfer performance of the toner particles prepared by the pulverizing method is poor. Therefore, the amount of toner required to form a toner image is necessarily increased, otherwise the toner image will not be transferred perfectly.

There is an increasing demand for the decrease of consumption of toner particles and the formation of high quality image with no partial omission, and further the reduction of running cost by increasing the image transfer efficiency. If the image transfer efficiency is remarkably high, it is not necessary to provide a cleaning unit for removing the toner particles remaining on the photoconductor or the intermediate image transfer member. This is capable of making the equipment compact, reducing the cost, and making use of the toner efficiently.

On the other hand, toner particles can be prepared by the suspension polymerization. To be more specific, an oily droplet comprising a monomer and a colorant is subjected to polymerization in water. By this method, the obtained toner particles are spherical. Therefore, the drawbacks caused by the amorphous shape of the toner particles obtained by the pulverizing method can be eliminated to some extent.

However, the suspension polymerization method has the shortcoming that it is difficult to prepare the toner particles in an intermediate shape between the spherical shape and the amorphous shape, which is considered to satisfy the image transfer performance and the cleaning properties at the same time.

Further, in order to increase the conversion from a monomer to a polymer in the course of suspension polymerization, it takes so much time to complete the polymerization.

In addition, when the wet polymerized particles are dried after separated from water, it is necessary to remove not only a water component but also a monomer component remaining in the porimerized particles. The removal of the monomer remaining in the polymerized particles is considerably difficult. This is because the toner particles obtained by polymerization tend to fuse and adhere to each other at a temperature lower than 100° C., so that the temperature for drying the particles is limited. Thus, the toner particles are dried at low temperature under reduced pressure. However, it takes so much time to dry the particles, thereby increasing the manufacturing cost.

Further, if the toner particles are not completely dried in the course of the above-mentioned drying step, the toner particles tend to adhere to each other while stored at high temperature. This will cause the blocking phenomenon. Or the monomer remaining in the toner particles tend to ooze out to the surface of the particles during the storage at high temperature, so that the charging properties of toner are unfavorably changed. As a result, it is impossible to produce high quality toner images.

When the toner particles are prepared by the suspension polymerization, the area of interface is large, so that large quantities of dispersants such as a surfactant, inorganic finely-divided particles, and a water-soluble polymeric protective colloid are essential in the polymerization. The above-mentioned dispersants are apt to leave on the toner particles thus obtained by polymerization. Under the circumstances of high temperature, such remaining dispersant components will have an adverse effect on the triboelectric charging characteristics which are determined by the surface of the toner particles.

To solve the above-mentioned problem, it is conventionally proposed to sufficiently wash the obtained toner particles for the removal of the dispersant therefrom. However, in this case, a large amount of wash water is necessary, and the facility for drain necessarily increases the manufacturing cost of toner.

The suspension polymerization is regarded as one of bulk polymerization from a microscopic viewpoint. Therefore, controlling is difficult so as to obtain polymers having low molecular weights and classified in a narrow molecular weight distribution. This becomes a serious problem when a full-color toner is prepared by the above-mentioned suspension polymerization method. To be more specific, the quality of a full-color toner image is determined by the smoothness and transparency of the image. If the molecular weight of a resin component for use in the full-color toner is excessively high, the full-color image cannot be fixed with satisfactory smoothness and transparency by the application of the same energy as required to fix a resin with a low molecular weight. For example, a low-molecular weight polyester with excellent fixing properties cannot be obtained by condensation polymerization in water, so that such a resin cannot be applied to the above-mentioned conventional suspension polymerization method.

Furthermore, it is difficult to finely disperse a colorant such as a pigment in a monomer without a dispersant. Although the colored performance of the obtained toner particles is improved by using a dispersant, the dispersant has an adverse effect on the charging characteristics of the obtained toner. In addition, when the hydrophilic nature of the employed pigment is strong, the pigment tends to shift to the interfaces of the particles in the course of polymerization, so that unsatisfactory color development cannot be expected.

The fluidity of the polymer particles prepared by suspension polymerization is good because the prepared particles are spherical. However, when those polymer particles are used as the toner particles, the above-mentioned inherent fluidity is insufficient. Therefore, finely-divided particles of a fluidity-imparting agent are used in combination with the toner particles. In this case, however, there is the problem that all particles of the fluidity-imparting agent do not adhere to the surface of the toner particles, and the fluidity-imparting agent particles initially attached to the toner particles will easily fall off. Those finely-divided particles of the fluidity-imparting agent which are not attached to the surface of the toner particles will contaminate or damage the surface of the photoconductor. Further, a cleaning blade will be worn away by those finely-divided particles of the fluidity-imparting agent.

In the method of producing a toner as disclosed in Japanese Laid-Open Patent Application 7-181740, the amount of residual monomer component and organic solvent component is regulated in order to prevent a releasing agent from moving to the surface of the toner particles. Namely, when the volatile component such as a monomer and an organic solvent remains in the toner particles prepared by suspension polymerization, a resin for use in the toner particles tends to be plasticized, so that the releasing agent is apt to ooze out. In this application, however, there is no trial to reduce or completely remove such volatile components. Therefore, the preservation stability and the charging characteristics of the obtained toner particles are still insufficient for practical use.

By the way, the spherical toner particles can be prepared in an aqueous medium not by using the above-mentioned suspension polymerization method. For instance, a resin and a colorant are dissolved and dispersed in an organic solvent. The thus obtained mixture is emulsified to form droplets, and thereafter, the water and the organic solvent are removed from the mixture, thereby obtaining toner particles. This preparation method has the shortcoming that it is difficult to obtain the toner particles in an arbitrary intermediate shape between the spherical shape and the amorphous shape. In addition, this preparation method employs an organic solvent, so that there is the same problem caused by the residual monomer and solvent component as mentioned in the suspension polymerization method. In this case, the employed organic solvent remains before the drying step, so that the amount of residual organic solvent is considerably large. Therefore, in the course of drying step, the toner particles become so adhesive that the toner particles tend to easily aggregate to form large particles. Even if a low boiling point solvent is employed, it takes so much time to remove the solvent from the inside of the particles in the drying step. Insufficient drying has a bad influence on the preservation stability and the charging characteristics of the toner. Further, after the drying step, there are observed void portions in the toner particles, which are generated by the evaporation of the solvent. Due to such void portions, the obtained toner particles become fragile, so that they are easily broken. Image formation will be hindered by such broken pieces of the toner particles in the developing unit. Further, in the case of this method, since a large quantity of solvent is employed, it is required to add the step of collecting and recycling the solvent. This will cause the increase of manufacturing cost.

Furthermore, the above-mentioned emulsifying method also employs a dispersant to stabilize the droplets in water. Such a dispersant induces the same problem as in the above-mentioned suspension polymerization method. In order to minimize the amount of dispersant to be employed, it is proposed to use a self-emulsifiable resin. However, such a self-emulsifiable resin tends to be unevenly distributed on the surface of the toner particles, so that the charging characteristics of the obtained toner will be impaired.

Although the resin available for the above-mentioned emulsifying method is not so strictly restricted as the resin for use in the suspension polymerization, it is necessary that the resin be soluble in a non-aqueous organic solvent. Further, a colorant such as a pigment cannot be readily dispersed in a resin solution without any dispersant. The resin is not always stably adsorbed by the pigment in the solution. The dispersant and the fluidity-imparting agent will cause the same problems as mentioned in the suspension polymerization method.

According to Japanese Laid-Open Patent Application 7-325429, the toner is prepared by the above-mentioned emulsifying method, with the amount of residual organic solvent being controlled. However, to reduce the residual organic solvent to such an amount as specified in the above-mentioned application, it is necessary to carry out a deaeration treatment under reduced pressure over a long period of time. When the deaeration treatment is carried out at high temperature for the purpose of curtailing the drying time, the toner particles tend to aggregate in the drying step. Further, the problems of the generation of void portions in the toner particles, the restriction of kind of resin to be employed, and the use of a large quantity of solvent remain unsolved in the above-mentioned application. In addition, it is difficult to finely disperse the pigment when any dispersant is not employed.

Apart from the above-mentioned preparation methods, there is proposed a method of preparing toner particles in such a manner that silica is added to resin particles comprising epoxy resin, with the polarity of the silica being opposite to that of the resin particles, and the thus obtained mixture is heated in a liquid in which the above-mentioned resin particles are insoluble, thereby preparing spherical toner particles, as disclosed in Japanese Laid-Open Patent Application 3-217850.

In the above-mentioned preparation method, a large amount of silica is required in order to prevent the resin particles from being fused and attached to each other under the application of heat thereto. However, a mixture of the silica particles and the resin particles cannot be easily wetted by the above-mentioned liquid and dispersed therein. Consequently, those particles cannot be dispersed in the liquid, and coalescence of particles will take place. Further, it is necessary to remove the above-mentioned silica particles in a large quantity because the silica only serves as an agent for preventing the resin particles from being fused and attached to each other in the course of the preparation of the toner.

In addition, this preparation method cannot produce toner particles in an arbitrarily controlled form. Furthermore, it takes so much time to prepare the toner particles. Therefore, this method is unfavorable from the industrial viewpoint.

SUMMARY OF THE INVENTION

Accordingly, a first object of the present invention is to provide a toner for use in electrophotography, which is odorless and exhibits good preservation stability without causing the blocking phenomenon during the storage at high temperature, and is capable of producing clear toner images which can be efficiently transferred to an image transfer medium without partial omission.

A second object of the present invention is to provide a toner for use in electrophotography which is controlled so as not to damage the photoconductor.

A third object of the present invention is to provide a toner for use in electrophotography which is capable of producing toner images on the image transfer medium without toner deposition on the background.

A fourth object of the present invention is to provide a method of producing the above-mentioned toner for use in electrophotography.

The above-mentioned first to third objects of the present invention can be achieved by a toner for use in electrophotography comprising toner particles, each toner particle comprising a resin, a colorant, a fluidity-imparting agent and a volatile organic component which is in an amount of 100 ppm or less per unit amount of the toner particles, and having an average spherical degree in a range of 100 to 150, which is calculated from a spherical degree (SD) of each toner particle defined by formula (I):

$$SD=25nL^2/S \quad (I)$$

wherein L is a maximum length of a projected cross-sectional image of each toner particle, and S is an area of the projected cross-sectional image of each toner particle.

The fourth object of the present invention can be achieved by a method of producing a toner for use in electrophotography comprising the steps of preparing primary particles, each particle comprising a resin and a colorant, depositing a fluidity-imparting agent on the surface of the primary particles, dispersing the fluidity-imparting agent deposited primary particles in a liquid comprising a dispersant, in which liquid the resin is insoluble, thereby preparing a dispersion of the primary particles, heating the dispersion with stirring, and cooling the dispersion, thereby obtaining toner particles for use in the toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
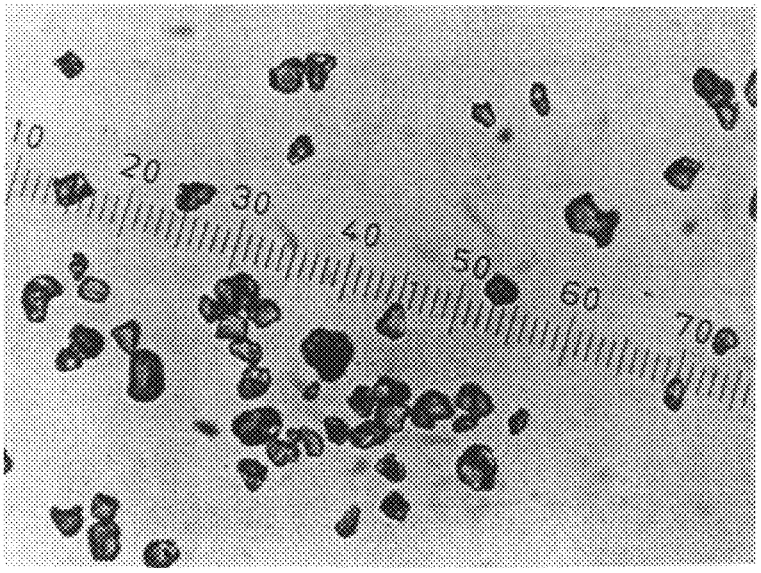
FIGS. 1 to 4 are micrographs which show the primary particles obtained in the course of producing a toner according to the present invention.

The toner according to the present invention comprises toner particles, each toner particle comprising a resin, a colorant and a fluidity-imparting agent. Further, the above-mentioned toner contains, a volatile organic component in an amount of 100 ppm or less per unit amount of the toner particles, and the average spherical degree of the toner particles is controlled to 100 to 150. Due to the above-specified average spherical degree, the toner image obtained from the toner of the present invention can be efficiently transferred to an image transfer medium such as a sheet of paper without partial omission. In addition, the toner itself is odorless and exhibits good preservation stability without causing the blocking during the storage at high temperature because the volatile organic component contained in the toner particles can be reduced to 100 ppm or less.

To be more specific, the above-mentioned volatile organic component contained in the toner particles includes a residual monomer component and a residual solvent. Such an organic volatile component has a bad effect on the preservation stability and charging characteristics of the toner at high temperature. In addition, the organic volatile component causes an unpleasant odor during the storage and in the course of image fixing process, which odor will jeopardize the safety to human body. Thus, according to the present invention, the volatile organic component is in an amount of 100 ppm or less per unit amount of the toner particles. When the concentration of the volatile organic component exceeds 100 ppm, the odor of toner itself becomes unbearable, and the preservation stability of the toner is very poor.

The presence of the volatile organic component contained in the toner particles can be detected by gas chromatography. To be more specific, the toner is dissolved in an appropriate solvent and the volatile component is then separated by column chromatography. The thus separated volatile component or the volatile organic component which is vaporized and comes out from the toner may be quantitatively measured by comparison with reference samples. For example, this measurement may be carried out with reference to an internal standard for a temperature-programmed method, using a fused silica capillary column and a detector (FID) of gas chromatography 5890 series made by Hewkett Packard. In this case, it is preferable that as the internal standard, a compound whose boiling point and polarity are close to those of the material to be detected and quantitatively measured be employed. For example, ethylbenzene and cyclopentanol are used as the internal standard.

The above-mentioned average spherical degree is calculated from a spherical degree (SD) of each toner particle defined by formula (I):

$$SD=25nL^2/S \quad (I)$$

where L is a maximum length of a projected cross-sectional image of each toner particle, and S is an area of the projected cross-sectional image of each toner particle.

As the value of the spherical degree of a toner particle comes nearer to 100, the shape of the toner particle approaches a complete sphere.

To be more specific, a great number of toner particles selected at random are observed by use of a scanning type electron microscope, and analyzed using an image processing analyzer, for example, a commercially available image analyzer "LUZEX III" (Trademark), made by Japan Regulator Corporation.

The average spherical degree of the toner particles is controlled to 100 to 150, preferably 100 to 120 in the present invention. Such toner particles are not easily rushed in the development unit, so that the transfer efficiency of the toner image obtained from the toner of the present invention is excellent, and high quality toner image can be clearly formed with no partial omission. When the average spherical degree of the toner particles exceeds 150, partial omission is increased in the transferred toner images.

Generally, it is preferable that the volatile organic component contained in the toner particles be as less as possible regardless of the shape of the toner particles. In particular, when the shape of the toner particles is spherical, that is, the average spherical degree of toner particles is closer to 100, the contact efficiency of the toner particles is increased, so that the toner particles tend to attach to each other. Thus, it is difficult to prevent the deterioration of the preservation stability and the charging characteristics of toner. According to the present invention, such deterioration of the preservation stability and the charging characteristics can be prevented by minimizing the volatile organic component in the toner particles.

In the toner of the present invention, it is preferable that a fluidity-imparting agent be present only on the surface of the toner particles. When all the particles of the fluidity-imparting agent are deposited on the surface of the toner particles, the photoconductor and the carrier can be prevented from being contaminated and damaged with the floating particles of the fluidity-imparting agent, and the cleaning blade can be prevented from being worn out. Thus, the deterioration of the quality of the toner image can be prevented.

The presence of the finely-divided particles of the fluidity-imparting agent not deposited on the surface of the toner particles can be easily observed by use of a scanning type electron microscope. To be more accurate, the toner is dispersed in an appropriate solvent to separate the toner particles from the solvent. The fluidity-imparting agent contained in the solvent, which is considered to fall off the toner particles, may be determined. The fluidity-imparting agent can be determined from the turbidity of the solvent or the detection of solid inorganic and organic elements contained in the solvent.

Further, it is preferable to eliminate the generation of void portions in the inside of the toner particles. When the toner particles are free from void portions, the image transfer performance can be improved and the deposition of toner on the background can be prevented. This is because the toner particles having no void portion therein are not easily broken in the development unit or the image forming equipment.

The inside of the toner particle can be examined in such a manner that the toner particles are embedded in a resin, and a very thin section is cut out from the resin-embedded toner particles, and observed by use of a transmission type electron microscope. When necessary, the section may be dyed using osmium or ruthenium.

As a matter of course, the void portions in the toner particles can be detected by the difference in contrast.

Further, the damage of the photoconductor by the toner particles can be prevented more efficiently when a charge control agent is steadily deposited on the surface of the toner particles.

Generally, the amount of charge control agent for use in the toner is not so much, but the particles of the charge control agent tend to easily fall off the toner particles while the toner particles are stirred in a development unit. Thus, the photoconductor and carrier particles are easily contaminated with the charge control agent.

The condition of the charge control agent on the toner particles can be observed by use of a scanning type electron microscope.

It is preferable that the softening point of the obtained toner particles be 50° C. or more, and the flow-initiating point thereof be 110° C. or less in order to produce excellent toner images. Namely, to obtain a toner image with high surface smoothness, sufficient glossiness and excellent quality, it is desirable that the toner be readily melted by the application of heat thereto, and uniformly spread on an image transfer medium such as a sheet of paper by use of a heat-application roller.

The softening point and the flow-initiating point of the toner particles are substantially the same as those of primary particles comprising a resin and a colorant obtained in the course of preparation of the toner particles.

To uniformly spread the toner on the image transfer medium such as a sheet of paper by use of the heat-application roller, it is preferable that the melt viscosity of the toner particles be 5000 Pa.s or less when the toner particles are heated to a temperature higher than the flow-initiating point thereof by 10° C. The above-mentioned melt viscosity can be obtained from the flowing speed of the toner from a nozzle of a cylinder, in other words, the descending speed of a plunger, in accordance with the Hagen-Poiseuille equation.

The materials constituting the toner of the present invention will now be explained in detail.

As the fluidity-imparting agent for use in the present invention, finely-divided particles of inorganic materials can be preferably employed. It is preferable that the particle diameter of the above-mentioned inorganic material be in the range of 0.5 to 500 $\mu$m, and more preferably in the range of 0.5 to 2 $\mu$m when the inorganic material is in the form of finely-divided particles. It is preferable that the specific surface of the inorganic finely-divided particles be in the range of 20 to 500 $m^2/g$ when measured by the BET method. Further, it is preferable that the amount of inorganic finely-divided divided particles be in the range of 0.01 to 5 wt. %, and more preferably in the range of 0.01 to 2.0 wt. %, of the total weight of the toner particles.

Examples of the inorganic finely-divided particles used for the fluidity-imparting agent are silica, alumina, titanium oxide, barium titanate, magnesium titanate, calcium titanate, strontium titanate, zinc oxide, siliceous sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

Such a fluidity-imparting agent may be surface-treated so as to enhance the hydrophobic nature thereof. This makes it possible to prevent the deterioration of the fluidity and the charging characteristics of the toner under the circumstance of high temperature. In this case, for example, there can be employed a silane coupling agent which may have an alkyl fluoride group, an organic titanate coupling agent, and an aluminum coupling agent as the agents for surface treatment.

Examples of the charge control agent for use in the present invention include a nigrosine dye such as a commercially available product commercially available product "Bontron 03" (Trademark) made by Orient Chemical Industries, Ltd., a quaternary ammonium salt such as a commercially available product "Bontron p-51" (Trademark) made by Orient Chemical Industries, Ltd., a metal-containing azo dye such as a commercially available product "Bontron S-34" (Trademark) made by Orient Chemical Industries, Ltd., an oxynaphthoic acid metal complex such as a commercially available product "E-82" (Trademark) made by Orient Chemical Industries, Ltd., a salicylic acid metal complex such as a commercially available product "E-84" (Trademark) made by Orient Chemical Industries, Ltd., a phenolic condensate such as a commercially available product "E-89" (Trademark), made by Orient Chemical Industries, Ltd., a quaternary ammonium salt molybdenum complex such as commercially available products "TP-302" and "TP-415" (Trademark), made by Hodogaya Chemical Co. Ltd., a quaternary ammonium salt such as a commercially available product "Copy Charge PSY VP2038" (Trademark) made by Hoechst Japan Limited, a triphenylmethane derivative such as a commercially available product "Copy Blue PR" (Trademark) made by Hoechst Japan Limited, a quaternary ammonium salt such as commercially available products "Copy Charge NEG VP2036" and "Copy charge NX VP434" (Trademark), made by Hoechst Japan Limited, a boron complex such as commercially available products "LR-147" and "LRA-901", made by Japan Carlit Co., Ltd., copper phthalocyanine pigment, perylene pigment, quinacridone pigment, azo pigment, and polymeric compounds having a functional group such as sulfonic group, carboxyl group, and quaternary ammonium salt.

Those charge control agents can be used alone or in combination.

The resin for use in the toner of the present invention will now be explained.

It is preferable that the resin for use in the toner comprise a polymer which comprises at least one monomer selected from the group consisting of a styrene monomer, acrylic monomer, methacrylic monomer, acrylic ester monomer, and methacrylic ester monomer.

Examples of the styrene monomer for use in the resin include o-methylstyrene, m-methylstyrene, p-methylstyrene, α-methylstyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene. These styrene monomers can be used alone or in combination.

Examples of the acrylic ester monomer for use in the resin include methyl acrylate, ethyl acrylate, butyl acrylate, isobutyl acrylate, propyl acrylate, octyl acrylate, dodecyl acrylate, lauryl acrylate, 2-ethylhexyl acrylate, stearyl acrylate, 2-chloroethyl acrylate, phenyl acrylate, and methyl α-chloroacrylate.

Examples of the methacrylic ester monomer for use in the resin include methyl methacrylate, ethyl methacrylate, propyl methacrylate, butyl mathacrylate, isobutyl methacrylate, octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate.

In addition to the above, it is preferable that the resin for use in the toner of the present invention comprise at least one resin component selected from the group consisting of a polyester resin, a polyol resin and an epoxy resin.

When the polymer resin is employed for the resin for use in the toner, the following polyhydric alcohols can be used for the preparation of the polyester resin: ethylene oxide adduct of bisphenol A, propylene oxide adduct of bisphenol A, ethylene glycol, 1,2-propylene glycol, 1,4-butanediol, 1,5-pentanediol, 1,6-hexanediol, neopentyl glycol, diethylene glycol, triethylene glycol, polyethylene glycol, polytetramethylene glycol, 1,4-cyclohexanedimethanol, trimethylolpropane, and pentaerythritol.

Examples of the polyvalent acid for the preparation of the polyester resin are terephthalic acid, isophthalic acid, o-phthalic acid, 2,6-naphthalenedicarboxylic acid, p-phenylenedicarboxylic acid, 1,4-cyclohexanedicarboxylic acid, succinic acid, glutaric acid, adipic acid, suberic acid, azelaic acid, sebacic acid, dodecanedioic acid, trimellitic acid, and pyromellitic acid.

When a polyhydric alcohol having three or more hydroxyl groups, and a polyvalent acid such as a polyvalent carboxylic acid are used to produce a polyester resin, the obtained resin is crosslinked. This is advantageous to the offset-resistance properties of the toner.

For the preparation of the polyol resin or epoxy resin used as the resin component for use in the present invention, a production obtained from bisphenol A and epichlorohydrin, a polyol of glycidyl ester type, or a polyacid of glycidyl ester type can be used.

Examples of the colorant for use in the toner of the present invention are carbon black, Nigrosine Dye, Aniline Blue, Calconyl Blue, Chrome Yellow, Ultramarine Blue, Du Pont Oil Red, Quinoline Yellow, Methylene Blue Chloride, Phthalocyanine Blue, Malachite Green Oxalate, Lamp Black, and Rose Bengale. Those colorants may be used alone or in combination.

In the present invention, the toner may further comprise a wax to impart the release properties to the obtained toner.

It is preferable to employ the wax with a melting point of 40 to 120° C., more preferably 50 to 110° C. in the present invention. When the melting point of the employed wax is within the above-mentioned range, sufficient fixing performance can be exhibited at low temperature, and the decrease of offset-resistance and durability can be prevented.

The melting point of the wax can be obtained using a differential scanning calorimeter (DSC). The melting peak value obtained by constantly heating a wax sample at a heating rate (10° C./min) is regarded as the melting point of the wax.

Examples of the wax for use in the present invention are solid paraffin wax, micro wax, rice wax, amide wax, fatty acid wax, fatty acid metallic salt wax, fatty ester wax, partially-saponified fatty ester wax, silicone wax, higher alcohol, and carnauba wax.

Further in the present invention, the toner may further comprise a polyolefin such as low-molecular weight polyethylene or polypropylene as an assistant for improving the fixing properties. In particular, it is preferable to employ a polyolefin with a softening point of 70 to 150° C., more preferably 120 to 150° C., when measured by the ring and ball method.

As an assistant for improving the cleaning properties, there can be employed a fatty acid such as stearic acid and metallic salts thereof, for example, zinc stearate and calcium stearate; and finely-divided particles of polymers synthesized by soap-free emulsion polymerization, for example, polymethyl methacrylate and polystyrene.

When the toner of the present invention is used as a magnetic toner, finely-divided particles of a magnetic substance may be contained in the toner particles.

Specific examples of the magnetic substance include ferromagnetic substances such as ferrite, magnetite, iron, nickel and cobalt, alloys thereof and compounds containing the above-mentioned elements; alloys which are not contain the above-mentioned ferromagnetic elements, but are capable of exhibiting the ferromagnetism by subjecting to proper heat treatment, for example, the Heusler's alloys such as an alloy of manganese, copper and aluminum, and an alloy of manganese, copper and tin; and chromium dioxide.

It is preferable that such a magnetic substance be uniformly dispersed in the form of finely-divided particles with an average particle size of 0.1 to 1 $\mu$m in the toner particles.

It is preferable that the amount of magnetic substance be in the range of 10 to 70 parts by weight, more preferably in the range of 20 to 50 parts by weight, to 100 parts by weight of the toner particles.

A dispersant may be used in the course of the preparation of the toner according to the present invention.

Examples of the dispersant for use in the present invention include anionic surfactants such as alkylbenzenesulfonate, α-olefin sulfonate, and phosphate; cationic surfactants such as alkylamine salt, amino-alcohol fatty acid derivatives, polyamine fatty acid derivatives, imidazoline, alkyl trimethylammonium salt, dialkyl dimethylammonium salt, alkyl dimethylbenzylammonium salt, pyridinium salt, alkyl isoquinolinium salt, and benzethonium chloride; and nonionic surfactants such as fatty acid amide derivatives, and polyhydric alcohol derivatives, and ampholytic surfactants such as alanine, dodecyl di(aminoethyl)glycine, di(octylaminoethyl)glycine, and N-alkyl-N, N-dimethylammonium betaine.

The effect of the dispersant can be remarkably improved in a small amount by using a surfactant having a fluoroalkyl group.

Examples of the anionic surfactant with a fluoroalkyl group are as follows: fluoroalkylcarboxylic acid having 2 to 10 carbon atoms, and metallic salts thereof, disodium perfluorooctane sulfonyl glutamate, sodium 3-[ω-fluoroalkyl ($C_6$–$C_{11}$)oxy]-1-alkyl ($C_3$–$C_4$) sulfonate, sodium 3-[ω-fluoroalkanoyl ($C_6$–$C_8$)-N-ethylamino]-1-propanesulfonate, fluoroalkyl ($C_{11}$–$C_{20}$) carboxylic acid and metallic salts thereof, perfluoroalkyl carboxylic acid ($C_7$–$C_{13}$) and metallic salts thereof, perfluoroalkyl ($C_4$–$C_{12}$) sulfonic acid and metallic salts thereof, perfluorooctane sulfonic acid diethanolamide, N-propyl-N-(2-hydroxyethyl) perfluorooctane sulfonamide, perfluoroalkyl ($C_6$–$C_{10}$) sulfonamide propyl trimethyl ammonium salt, perfluoroalkyl ($C_6$–$C_{10}$)-N-ethylsulfonyl glycine salt, and monoperfluoroaklyl ($C_6$–$C_{16}$) ethyl phosphate.

Examples of the commercially available anionic fluorochemical surfactant for use in the present invention include SURFLON S-111, S-112 and S-113 (made by Asahi Glass Co., Ltd.), FLUORAD FC-93, FC-95, FC-98 and FC-129 (made by Sumitomo 3M Limited), UNIDYNE DS-101 and DS-102 (made by Daikin Industries, Ltd.), MEGAFAC F-110, F-120, F-113, F-191, F-812 and F-833 (made by Dainippon Ink & Chemicals, Incorporated), EETOP EF-102, 103, 104, 105, 112, 123A, 123B, 306A, 501, 201 and 204 (made by Tohkem Products Corporation), and FTERGENT F-100 and F-150 (Neos Co., Ltd.).

Examples of a cationic fluorochemical surfactant for use in the present invention include an aliphatic primary, secondary or tertiary amine salt having a fluoroalkyl group; an aliphatic quaternary ammonium salt such as perfluoro-alkyl ($C_6$–$C_{10}$) sulfonamide propyltrimethyl ammonium salt; benzalkonium salt; benzethonium chloride; pyridinium salt; and imidazolinium salt.

Examples of the commercially available cationic fluorochemical surfactant for use in the present invention include SURFLON S-121 (made by Asahi Glass Co., LTD.), FLUORAD FC-135 (made by Sumitomo 3M Limited), YUNIDYNE DS-202 (made by Daikin Industries, LTD.), MEGAFAC F-150, and F-824 (made by Dainippon Ink & Chemicals, Incorporated), EFTOP EF-132 (made by Tohkem Products Corporation), and FTERGENT F-300 (Neos Co., Ltd.).

Further, an inorganic compound which is slightly soluble in water, such as dicalcium phosphate, calcium carbonate, titanium oxide, colloidal silica, or hydroxyapatite can be also used as the dispersant.

In the preparation of the toner of the present invention a polymeric protective colloid may be employed for stabilizing the primary particles.

Examples of the polymeric protective colloid include acids such as acrylic acid, methacrylic acid, α-cyanoacrylic acid, α-cyanomethacrylic acid, itaconic acid, crotonic acid, fumaric acid, maleic acid and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerin monoacrylic ester, glycerin monomethacrylic ester, N-methylolacrylamide, and N-methylolmethacrylamide; vinyl alcohol and ethers thereof such as vinylmethyl ether, vinylethyl ether and vinylpropyl ether; esters of vinyl alcohol and carboxyl-group-containing compound such as vinyl acetate, vinyl propionate, and vinyl butyrate; acrylamide, methacrylamide, diacetone acrylamide, and methylol compounds thereof; acid chlorides such as acrylic acid chloride, and methacrylic acid chloride; nitrogen-containing or heterocyclic homopolymers and copolymers such as vinyl pyridine, vinyl pyrrolidone, vinyl imidazole, and ethyleneimine; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

The toner of the present invention can be used as a one-component developer or a two-component developer together with a carrier. For the preparation of the two-component developer, the carrier particles with a particle size of several tens of micrometers to several hundreds of micrometers, made of ferromagnetic metals such as ferrite, magnetite, iron, cobalt and nickel, and alloys thereof can be employed. Further, those metallic particles may be coated with a polymeric compound such as styrene resin which may have fluorine atom, acrylic resin, silicone resin, polyurethane resin, polyethylene or polypropylene.

The method of producing the above-mentioned toner according to the present invention will now be explained.

The method of producing a toner for use in electrophotography comprises the steps of:

- preparing primary particles, each particle comprising a resin and a colorant,
- depositing a fluidity-imparting agent on the surface of the primary particles,
- dispersing the fluidity-imparting agent deposited primary particles in a liquid comprising a dispersant, in which liquid the resin is insoluble, thereby preparing a dispersion of the primary particles, heating the dispersion with stirring, and cooling the dispersion, thereby obtaining toner particles of the toner according to the present invention.

The components other than a resin, for example, the fluidity-imparting agent and the charge control agent that are present on the outer surface of the primary particles are fixedly deposited on the surface of the toner particles by heat treatment under the specific conditions according to the method of the present invention. Thus, the constituent components other than the resin can be prevented from falling off the surface of the obtained toner particles.

In the method of the present invention, it doesn't take much time to carry out the operation of each step, so that this method can be applied to the successive manufacturing process.

Figure 5:
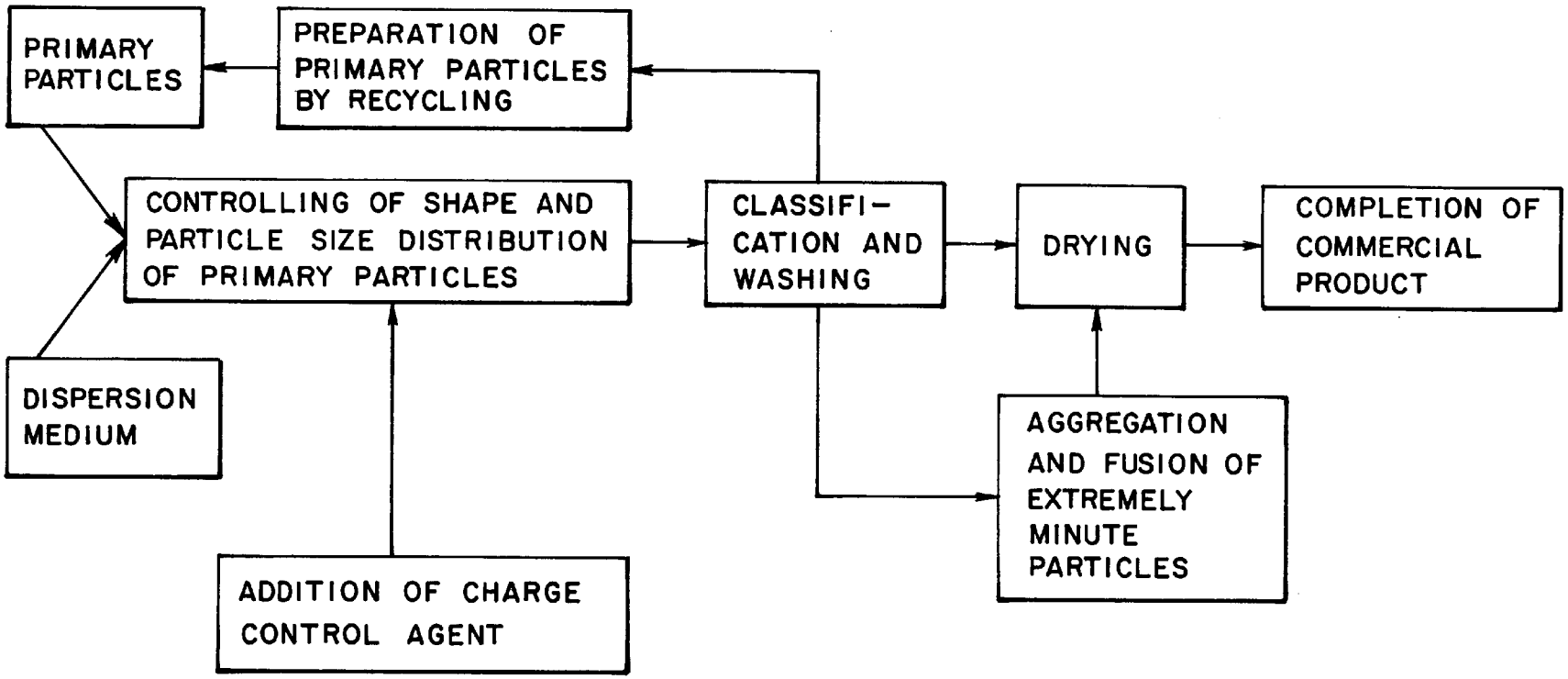
FIG. 5 is a flow chart in explanation of one example of the method of industrially manufacturing the toner according to the present invention.

FIG. 5 is a flow chart which shows one example of the manufacturing process of the toner according to the present invention.

In accordance with the flow chart as shown in FIG. 5, primary particles comprising a resin and a colorant, and a liquid which is a dispersion medium for the primary particles are simultaneously placed in a mixer where they are mixed and dispersed. As the thus obtained dispersion is flowing, it is successively subjected to heating and cooling operations to control the shape of primary particles and the particle size distribution. It takes a short period of time of the order of minutes to carry out these operations.

Then, the dispersion of the primary particles is caused to pass through a classification and washing zone. In this zone, the primary particles in the dispersion are simultaneously washed and classified to obtain a desired particle size distribution.

The classified particles are dried in a drying zone, thereby obtaining a toner according to the present invention as a commercial product.

In the above-mentioned classification and washing zone, extremely minute particles and coarsely crushed particles which are separated from the particles with a desired particle size can be recycled for the preparation of the primary particles by subjecting to aggregation and pulverization. Further, in particular, the extremely minute particles obtained in the classification and washing zone can be made into the toner particles by aggregating the minute particles with fusing.

The dispersion medium for the primary particles can be repeatedly used.

Each step in the method of producing the toner will be explained in more detail.

(1) Step of preparing primary particles:

A resin and a colorant are mixed to prepare primary particles.

It is desirable that the primary particles have an average particle diameter and a particle size distribution near to those of the desired toner particles to be obtained at the final stage. However, in light of the productivity and the manufacturing cost, the primary particles which are different from the desired toner particles in terms of the average particle diameter and the particle size distribution may be prepared.

In the course of the step of preparing the primary particles, a magnetic substance, a charge control agent and a releasing agent may be added to the resin and the colorant.

The primary particles in the form of amorphous is favorable to an operation for controlling the particle shape to be conducted later, but the primary particles may be spherical.

It is desirable that the amount of volatile organic component contained in the primary particles be as low as possible although the volatile organic component can be removed therefrom in the course of the heating and drying steps.

(2) Step of depositing fluidity-imparting agent on primary particles:

Conventionally, after a mixture of a resin and a colorant is kneaded, the kneaded mixture is subjected to pulverization and classification to prepare toner particles. These toner particles are mixed with particles of a fluidity-imparting agent to deposit the fluidity-imparting agent on the surface of the toner particles.

In contrast to this, according to the present invention, the fluidity-imparting agent is deposited on the primary particles comprising a resin and a colorant, and the fluidity-imparting agent deposited primary particles thus obtained are heated so as to control the shape of those primary particles. Since the fluidity-imparting agent is mixed with the primary particles before the operation for controlling the particle shape by heating, it is possible to fix the fluidity-imparting agent on the surface of the primary particles in the course of the operation for controlling the particle shape by heating even though the particles of the fluidity-imparting agent have fallen off the surface of the primary particles.

Further, the fluidity-imparting agent can effectively work to prevent the aggregation of the primary particles in the operation for controlling the particle size and shape under the application of heat.

It is preferable that the amount of fluidity-imparting agent be 2 wt. % or less of the total weight of the primary particles. When the amount of fluidity-imparting agent is within the above-mentioned range, the effect of the fluidity-imparting agent can be sufficiently expected, and the fluidity-imparting agent can be placed only on the surface of the obtained toner particles.

(3) Step of dispersing fluidity-imparting agent deposited primary particles in liquid comprising dispersant:

The fluidity-imparting agent deposited primary particles are dispersed in a liquid comprising a dispersant, in which liquid the resin for use in the primary particles is insoluble. The above-mentioned liquid is regarded as a dispersion medium for the fluidity-imparting agent deposited primary particles.

Such a liquid may be mixed with an organic solvent in which the above-mentioned resin swells or is soluble.

Specific examples of the liquid for dispersing the fluidity-imparting agent deposited primary particles include water; organic solvents capable of being diluted with water, for example, alcohols such as methanol and ethanol, ketones such as acetone, aromatic solvents such as benzene and toluene, paraffin-based hydrocarbon solvents such as n-hexane, and halogenated hydrocarbon solvents; and mixed solvents containing water and the above-mentioned organic solvents.

For the preparation of a black toner, it is preferable to use the above-mentioned mixed solvent of water and the organic solvent.

In the mixed solvent of water and the organic solvent in which the resin can swell or can be dissolved, the primary particles can be easily dispersed in the obtained mixed solvent serving as a dispersion medium and the heating temperature of the dispersion of the fluidity-imparting agent deposited primary particles can be decreased. However, when such an organic solvent is used in a large quantity, the energy and time required to dry the toner particles are unfavorably increased.

The above-mentioned liquid, that is, the dispersion medium, comprises a dispersant in order to sufficiently wet the fluidity-imparting agent deposited primary particles with the above-mentioned liquid and separately disperse each of the fluidity-imparting agent deposited primary particles in the liquid. In this case, it is desirable to dissolve or disperse the dispersant in the liquid before dispersing the fluidity-imparting agent deposited primary particles in the liquid.

(4) Step of heating dispersion for controlling particle shape:

After the fluidity-imparting agent deposited primary particles are added to the liquid comprising the dispersant, it is preferable to stir the mixture until the fluidity-imparting agent deposited primary particles are completely wetted and dispersed in the liquid. Thereafter, the dispersion is heated with moderately stirring so as to prevent the primary particles from settling or floating. For controlling the shape of the fluidity-imparting agent deposited primary particles, it is preferable that the dispersion be heated to a temperature near the softening point of the primary particles in the heating step.

The shape of the fluidity-imparting agent deposited primary particles is mainly determined by the heating temperature, and heating may be continued for 5 minutes or more after the temperature of the dispersion reaches a predetermined heating temperature.

Furthermore, in the case where the primary particles include a large quantity of extremely minute particles, these extremely minute particles may be separately collected. Such extremely minute particles can be aggregated in a solvent under the unstable condition and fused into each other. Thus, these minute particles can be made into the toner particles by controlling the particle size. In this case, mechanical energy, ionic electrostatic force, or adhesion caused by swelling in the solvent may be utilized.

(5) Step of adding charge control agent:

When the obtained toner cannot be sufficiently charged by triboelectric charging, a charge control agent may be deposited on the surface of the toner particles.

To deposit the charge control agent on the surface of the toner particles, the following methods are usable:

(a) A charge control agent is added to the resin and the colorant in the step of preparing the primary particles. In this case, the charge control agent can be fixed to the surface of the primary particles during the above-mentioned hating step for controlling the shape of the primary particles.

(b) A charge control agent is added to the dispersion of the fluidity-imparting agent deposited primary particles before or after the heating step. In this case, the charge control agent can be more fixedly deposited on the toner particles by adding a liquid in which the resin for use in the primary particles is soluble or swells to the dispersion of the fluidity-imparting agent deposited primary particles.

The charge control agent may be dissolved in a liquid which can be diluted with the dispersion medium for the primary particles. When such a solution of the charge control agent is mixed with the dispersion of the primary particles, the charge control agent can separate out and can be deposited on the primary particles.

(6) Step of cooling:

It is preferable that the dispersion of the fluidity-imparting agent deposited primary particles be cooled to a temperature lower than the softening point of the resin for use in the primary particles, or preferably to room temperature.

(7) Step of classification of fluidity-imparting agent deposited primary particles:

When the particle size distribution of the primary particles is wide and the adjustment of the particle size distribution is not carried out in the heating step, the fluidity-imparting agent deposited primary particles in the dispersion may be classified by use of hydro cyclone, decanter or centrifugal separator after the heating and cooling steps.

As a matter of course, it is possible to classify the fluidity-imparting agent deposited primary particles after drying. However, to classify the particles in the dispersion is more efficient.

The extremely minute particles and coarsely crushed particles separated from the particles with desired particle size can be again used for the preparation of the primary particles. It is very advantageous from the viewpoint of recycling. In such a recycling process, the extremely minute particles and coarsely crushed particles may be in a wet condition when they are kneaded with a resin and a colorant for the preparation of the primary particles.

In particular, the extremely minute toner particles separated by the classification can be made into the toner particles with desired particle size by adjusting the particle size in accordance of the same aggregating method as employed in the heating step, thereby increasing the yield of the product.

(8) Washing step:

It is preferable to remove the employed dispersant as much as possible from the dispersion of the fluidity-imparting agent deposited primary particles by washing operation. The washing operation may be simultaneously carried out with the above-mentioned classification operation.

The dispersant attached to the obtained toner particles can be removed therefrom by acid-alkali treatment or decomposition using an enzyme.

(9) Drying step:

The toner particles thus obtained comprises a volatile organic component in a remarkably small amount, so that only the water component in the toner particles may be removed therefrom by the drying operation. Therefore, a desired product can be obtained by short-time drying using a dryer such as spray dryer, belt dryer or rotary kiln.

(19) Surface treatment step:

The toner particles obtained by the above-mentioned drying step can be mixed with finely-divided particles of various agents such as a releasing agent, a charge control agent, a fluidity-imparting agent, and a colorant. Further, by the application of mechanical impact to the thus obtained mixture of particles, those finely-divided particles of various agents can be fixedly deposited on the surface of the toner particles or uniformly blended with the toner particles on the surface thereof. Thus, the particles of various agents attached to the surface of the toner particles can be prevented from falling off.

To be more specific, there are the method of applying the impact to the mixed particles using a blade rotating at high revolution, and the method of putting the mixed particles into an air stream flowing at high speed, and making the particles come into collision and the obtained composite particles strike against a proper plate by accelerating the air stream. For example, there can be employed a commercially available powder surface modification system, "Ang mill" (Trademark), made by Hosokawa Micron Corporation; a system obtained by modifying "Impact Mill" (Trademark), made by Nippon Pnewmatic Mfg. Co., Ltd. by descending the air pressure for pulverizing; a system "Hybridization System" (Trademark), made by Nara Machinery Co., Ltd.; and a system "Kryptron System" (Trademark), made by Kawasaki Heavy Industries, Ltd.; and an automatic mortar.

FIGS. 1 to 4 are micrographs of the primary particles for the preparation of the toner according to the present invention, which are taken at a magnification of 500×, with the ruler shown in each micrograph having a scale at regular intervals of 3 $\mu$m.

Figure 2:
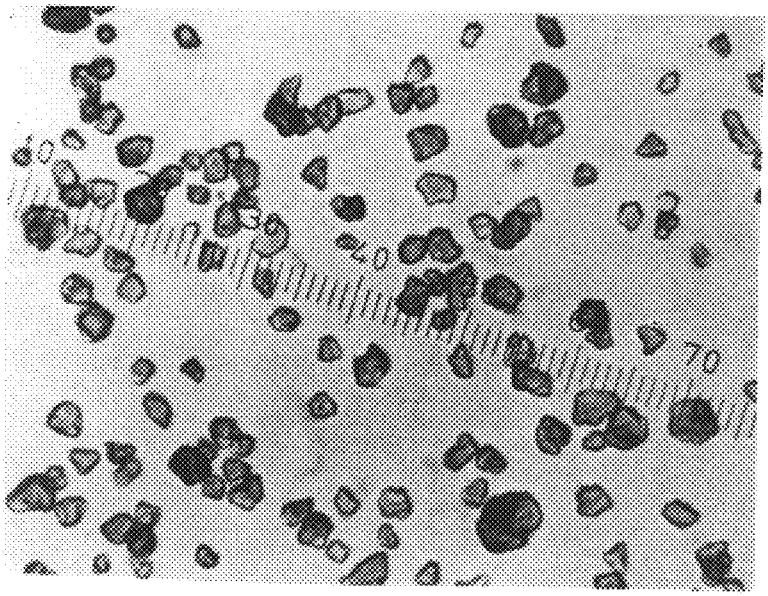
Figure 3:
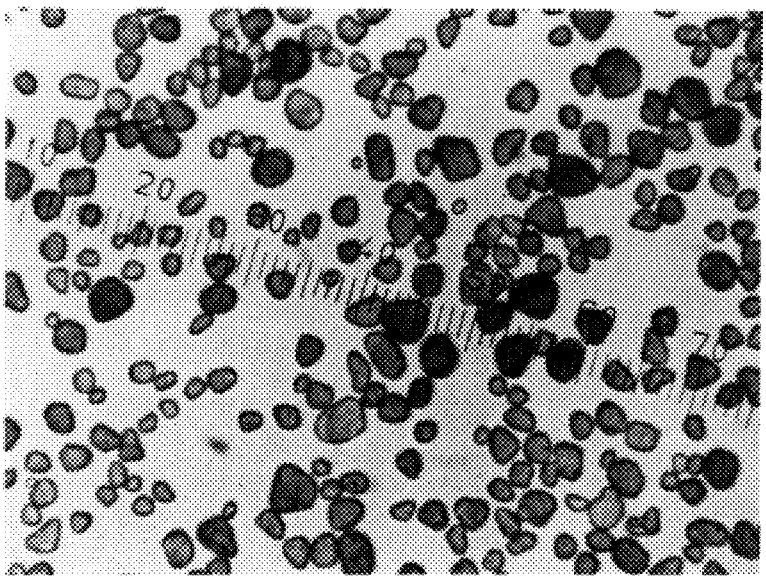
Figure 4:
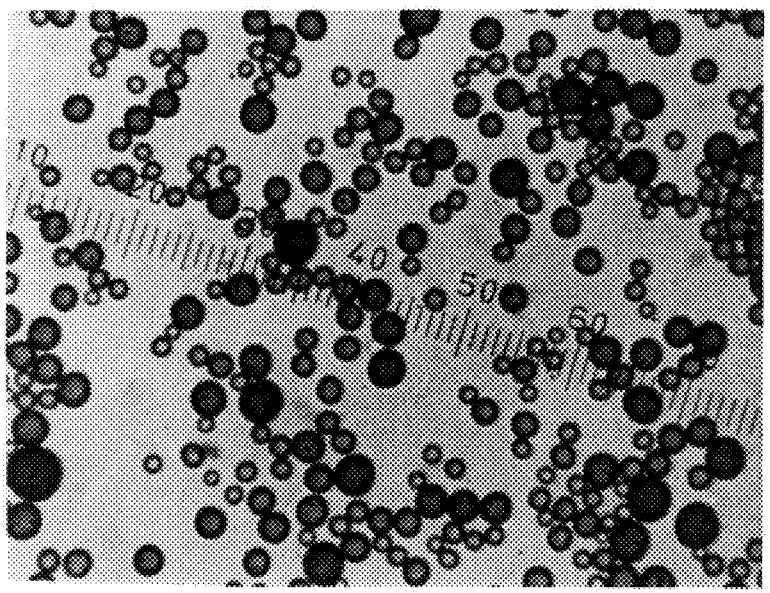

The micrograph of FIG. 1 shows the primary particles obtained immediately after dispersing the primary particles in water. These primary particles are angular. The primary particles shown in FIG. 2 and FIG. 3 are those obtained after the dispersion of the primary particles is heated at 60° C. and 65° C. respectively. The edge portions of the primary particles become round with the increase of the heating temperature, as shown in FIGS. 2 and 3. Finally, the primary particles shown in FIG. 4, which are obtained after the dispersion of the primary particles is heated at 70° C., are in the completely spherical form.

Other features of this invention will become apparent in the course of the following description of exemplary embodiments, which are given for illustration of the invention and are not intended to be limiting thereof.

EXAMPLE 1

Preparation of primary particles

A mixture of the following components was kneaded and dispersed in a two-roll mill under the application of heat thereto:

| | Parts by weight |
|---|---|
| Partially-crosslinked styrene - n-butyl methacrylate copolymer | 100 |
| Carbon black | 10 |
| Zinc di-t-butyl salicylate | 3 |
| Low-molecular weight polypropylene | 5 |

The thus prepared mixture was cooled and roughly crushed, pulverized in a jet mill, and then classified by air classification so as to remove extremely minute particles. Thus, primary particles were prepared.

100 parts by weight of the above prepared primary particles and 0.5 parts by weight of hydrophobic silica were mixed in a mixer.

In a container, 25 parts by weight of the silica-deposited primary particles were added to 100 parts by weight of deionized water containing 1 wt. % of partially-saponified polyvinyl alcohol with stirring, and the mixture was further stirred for 10 minutes. After the completion of stirring, it was confirmed by visual observation that the silica-deposited primary particles were completely wetted with the aqueous solution. Further, it was observed by the optical microscope that each of the silica-deposited primary particles was separately dispersed in the aqueous solution.

The container was put in hot water to heat the mixture in the container to 85° C. with stirring, and the internal temperature was maintained at 85° C. for 10 minutes. Thereafter, the mixture was cooled to 20° C.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried in an oven at 40° C. until a constant weight was reached.

Thus, a toner (a) according to the present invention was obtained.

EXAMPLE 2

The primary particles were prepared in the same manner as in Example 1.

In a container, 25 parts by weight of the above prepared primary particles were added to 100 parts by weight of deionized water containing 1 wt. % of partially-saponified polyvinyl alcohol with stirring, and the mixture was further stirred for 10 minutes. After the completion of stirring, it was confirmed by visual observation that the primary particles were completely wetted with the aqueous solution. Further, it was observed by the optical microscope that each of the primary particles was separately dispersed in the aqueous solution.

The container was put in hot water to heat the mixture in the container to 85° C. with stirring, and the internal temperature was maintained at 85° C. for 10 minutes. Thereafter, the mixture was cooled to 20° C.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried in an oven at 40° C. until a constant weight was reached.

100 parts by weight of the dried particles were mixed with 0.5 parts by weight of hydrophobic silica in a mixer, so that a toner (b) according to the present invention was obtained.

EXAMPLE 3

The procedure for preparation of the toner (a) according to the present invention in Example 1 was repeated except that the dispersion of the silica-deposited primary particles was heated at 90° C. for 20 minutes in the heating step.

Thus, a toner (c) according to the present invention was obtained.

EXAMPLE 4

The procedure for preparation of the toner (a) according to the present invention in Example 1 was repeated except that the dispersion of the silica-deposited primary particles was heated at 85° C. for 20 minutes.

Thus, a toner (d) according to the present invention was obtained.

EXAMPLE 5

Preparation of primary particles

A mixture of the following components was kneaded and dispersed in a two-roll mill under the application of heat thereto:

| | Parts by Weight |
|---|---|
| Partially-crosslinked polyester resin | 50 |
| Particles of iron oxide | 50 |
| Zinc di-t-butyl salicylate | 3 |
| Paraffin wax | 5 |

The thus prepared mixture was cooled and roughly crushed, pulverized in a jet mill, and then classified by air classification so as to remove extremely minute particles. Thus, primary particles were prepared.

100 parts by weight of the above prepared primary particles and 0.5 parts by weight of hydrophobic silica were mixed in a mixer.

In a container, 30 parts by weight of the silica-deposited primary particles were added to 100 parts by weight of deionized water containing 0.3 wt. % of sodium dodecylbenzenesulfonate with stirring, and the mixture was further stirred for 15 minutes. After the completion of stirring, it was confirmed by visual observation that the silica-deposited primary particles were completely wetted with the aqueous solution. Further, it was observed by the optical microscope that each of the silica-deposited primary particles was separately dispersed in the aqueous solution.

The container was put in hot water to heat the internal temperature of the mixture to 80° C. with stirring so as not to cause the silica-deposited primary particles to settle to the bottom of the liquid. The temperature was maintained at 80° C. for 10 minutes. Thereafter, the dispersion was cooled to 20° C.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried in an oven at 40° C. until a constant weight was reached.

Thus, a toner (e) according to the present invention was obtained.

EXAMPLE 6

Preparation of primary particles

A mixture of the following components was kneaded and dispersed in a two-roll mill under the application of heat thereto:

| | Parts by weight |
|---|---|
| Partially crosslinked styrene-acrylic resin | 100 |
| Carbon black | 10 |
| Low-molecular weight polypropylene | 5 |

The thus prepared mixture was cooled and roughly crushed, pulverized in a jet mill, and then classified by air classification so as to remove extremely minute particles. Thus, primary particles were prepared.

100 parts by weight of the above prepared primary particles, 0.5 parts by weight of hydrophobic silica, and 0.3 parts by weight of zinc di-t-butylsalicylate were mixed in a mixer.

In a container, 25 parts by weight of the primary particles on which silica and zinc di-t-butylsalicylate were deposited were added to 100 parts by weight of deionized water containing 1 wt. % of partially-saponified polyvinyl alcohol with stirring, and the mixture was further stirred for 10 minutes. After the completion of stirring, it was confirmed by visual observation that the primary particles were completely wetted with the aqueous solution. Further, it was observed by the optical microscope that each of the primary particles was separately dispersed in the aqueous solution.

The container was put in hot water to heat the mixture to 85° C. with stirring, and the internal temperature of the container was maintained at 85° C. for 10 minutes. Thereafter, the mixture was cooled to 20° C.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried in an oven at 40° C. until an constant weight was reached.

Thus, a toner (f) according to the present invention was obtained.

EXAMPLE 7

Preparation of primary particles

A mixture of the following components was kneaded and dispersed in a three-roll mill under the application of heat thereto:

| | Parts by Weight |
|---|---|
| Polycondensation polyester resin prepared from terephthalic acid and polyoxyethylene adduct of bisphenol A | 100 |
| Copper phthalocyanine pigment | 3 |
| Zinc di-t-butyl salicylate | 3 |

The thus prepared mixture was cooled and roughly crushed, pulverized in a jet mill, and then classified by air classification so as to remove extremely minute particles. Thus, primary particles were prepared.

100 parts by weight of the above prepared primary particles and 0.8 parts by weight of hydrophobic silica were mixed in a mixer.

In a container, 40 parts by weight of the silica-deposited primary particles were added to 100 parts by weight of deionized water containing 0.1 wt. % of sodium lauryl sulfate with stirring, and the mixture was further stirred for 10 minutes. After the completion of stirring, it was confirmed by visual observation that the silica-deposited primary particles were completely wetted with the aqueous solution. Further, it was observed by the optical microscope that each of the silica-deposited primary particles was separately dispersed in the aqueous solution.

The container was put in hot water to heat the mixture in the container to 70° C. with stirring, and the internal temperature was maintained at 70° C. for 15 minutes. Thereafter, the mixture was cooled to 20° C.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried in an oven at 35° C. until a constant weight was reached.

Thus, a toner (g) according to the present invention was obtained.

EXAMPLE 8

The preparation of the toner (g) according to the present invention in Example 7 was repeated except that the polycondensation polyester resin used for the preparation of the primary particles in Example 7 was replaced by a condensation product of bisphenol A and p-cumylphenol alkylene oxide modified epoxy resin.

Thus, a toner (h) according to the present invention was obtained.

EXAMPLE 9

The preparation of the toner (g) according to the present invention in Example 7 was repeated except that the polycondensation polyester resin prepared from terephthalic acid and polyoxyethylene adduct of bisphenol A used for the preparation of the primary particles in Example 7 was replaced by a polycondensation polyester resin prepared from terephthalic acid and polypropylene oxide adduct of bisphenol A.

Thus, a toner (i) according to the present invention was obtained.

EXAMPLE 10

The procedure for preparation of the toner (a) according to the present invention in Example 1 was repeated except that the dispersion of the silica-deposited primary particles was heated at 90° C. for 5 minutes.

Thus, a toner (j) according to the present invention was obtained.

EXAMPLE 11

The procedure for preparation of the toner (a) according to the present invention in Example 1 was repeated except that the dispersion of the silica-deposited primary particles was heated at 90° C. for 30 minutes.

Thus, a toner (k) according to the present invention was obtained.

EXAMPLE 12

Preparation of primary particles

A mixture of the following components was kneaded and dispersed in a two-roll mill under the application of heat thereto:

| | Parts by Weight |
|---|---|
| Partially-crosslinked styrene-acrylic resin | 100 |
| Carbon black | 10 |
| Low-molecular weight polypropylene | 5 |

The thus prepared mixture was cooled and roughly crushed, pulverized in a jet mill, and then classified by air classification so as to remove extremely minute particles. Thus, primary particles were prepared.

100 parts by weight of the above prepared primary particles and 0.5 parts by weight of hydrophobic silica were mixed in a mixer.

In a container, 25 parts by weight of the silica-deposited primary particles were dispersed in 100 parts by weight of deionized water containing 1 wt. % of partially-saponified polyvinyl alcohol, and the thus obtained dispersion was heated to 85° C.

Thereafter, 5 parts by weight of zinc t-butylsalicylate, 0.5 parts by weight of sodium dodecylbenzenesulfonate, and 94.5 parts by weigh of deionized water were dispersed in a ball mill for 24 hours. 1.5 parts by weight of the thus prepared dispersion of zinc di-t-butylsalicylate and 10 parts by weight of acetone were added to the previously obtained dispersion of the silica-deposited primary particles, and the resultant mixture was stirred for 10 minutes, followed by cooling.

The thus obtained mixture was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried in an oven at 40° C. until a constant weight was reached.

Thus, a toner (l) according to the present invention was obtained.

EXAMPLE 13

The primary particles were prepared in the same manner as in Example 12.

100 parts by weight of the above prepared primary particles and 0.5 parts by weight of hydrophobic silica were mixed in a mixer.

In a container, 25 parts by weight of the silica-deposited primary particles were dispersed in 100 parts by weight of deionized water containing 1 wt. % of partially-saponified polyvinyl alcohol, and the thus obtained dispersion was heated to 85° C. with stirring for 10 minutes, followed by cooling.

The thus obtained mixture was subjected to centrifugal sedimentation, and then the resultant supernatant liquid was removed. The residue thus obtained was dispersed again in deionized water in the same amount of that of the removed supernatant liquid. Such a washing process was repeated three times.

To the thus obtained dispersion, 7.5 parts by weight of methanol solution of 1 wt. % of zinc di-t-butylsalicylate were added, and the resultant mixture was stirred. Then, the mixture was dried using a commercially available spray dryer (made by Yamato Scientific Co., Ltd.).

Thus, a toner (m) according to the present invention was obtained.

EXAMPLE 14

The primary particles were prepared in the same manner as in Example 1 except that air classification was not carried out after pulverization by the jet mill.

100 parts by weight of the primary particles not subjected to classification and 0.5 parts by weight of hydrophobic silica were mixed in a mixer.

In a container, 25 parts by weight of the silica-deposited primary particles were added to 100 parts by weight of deionized water containing 1 wt. % of partially-saponified polyvinyl alcohol with stirring, and the mixture was further stirred for 10 minutes. After the completion of stirring, it was confirmed by visual observation that the silica-deposited primary particles were completely wetted with the aqueous solution. Further, it was observed by the optical microscope that each of the silica-deposited primary particles was separately dispersed in the aqueous solution.

The container was put in hot water to heat the mixture in the container to 85° C. with stirring, and the internal temperature was maintained at 85° C. for 10 minutes. Thereafter, the mixture was cooled to 20° C.

The thus obtained dispersion was subjected to washing and classification at the same time with monitoring the particle size distribution of the toner particles precipitated by the centrifugal sedimentation. Such a simultaneous washing and classification operation was repeated so as to obtain a dispersion of the toner particles having the same particle size distribution as obtained in Example 1 by removing the extremely minute particles.

The thus obtained dispersion was subjected to filtration under reduced pressure, and the obtained product was dried in an oven at 40° C. until a constant weight was reached.

Thus, a toner (n) according to the present invention was obtained.

EXAMPLE 15

The supernatant liquid obtained after centrifugal sedimentation in the washing and classification operation in Example 14 was collected, and subjected to centrifugal sedimentation again at high revolution in order to completely separate a solid substance from a liquid. Thus, the extremely minute particles were obtained by drying the above obtained precipitate.

20 parts by weight of the thus obtained extremely minute particles were mixed with the same composition of the primary particles as prepared in Example 1.

From the primary toner particles thus prepared, a tone (o) according to the present invention was obtained in the same manner as in Example 1.

EXAMPLE 16

The supernatant liquid obtained after centrifugal sedimentation in the washing and classification operation in Example 14 was collected. The thus obtained dispersion of the extremely minute particles was stirred at a speed of 1000 rpm with the temperature of the dispersion being adjusted to 95° C., so that the particles were aggregated. After the thus aggregated particles were allowed to stand in the dispersion, they were sedimented. Those aggregated particles were separated from the dispersion and dried.

20 parts by weight of the thus obtained aggregated particles were mixed with the same composition of the primary particles as prepared in Example 1.

From the primary particles thus prepared, a toner (P) according to the present invention was obtained in the same manner as in Example 1.

EXAMPLE 17

The supernatant liquid obtained after centrifugal sedimentation in the washing and classification operation in Example 14 was collected, and subjected to centrifugal sedimentation again at high revolution in order to completely separate a solid substance from a liquid.

The thus obtained precipitate was taken out and not subjected to drying. This wet material in an amount of 20 parts by weight in terms of a solid content was mixed with the same composition of the primary particles as prepared in Example 1.

When the thus obtained mixture was kneaded for the preparation of the primary particles, the kneaded mixture assumed an expanded state. As a result, the crushability of the mixture was improved.

In a container, 25 parts by weight of the thus prepared primary particles were added to 100 parts by weight of deionized water containing 1 wt. % of partially-saponified polyvinyl alcohol with stirring, and the mixture was further stirred for 10 minutes. After the completion of stirring, it was confirmed by visual observation that the primary particles were completely wetted with the aqueous solution. Further, it was observed by the optical microscope that each of the primary particles was separately dispersed in the aqueous solution.

The container was put in hot water to heat the mixture in the container to 85° C. with stirring, and the internal temperature was maintained at 85° C. for 10 minutes. Thereafter, the mixture was cooled to 20° C.

The thus obtained dispersion was subjected to washing and classification at the same time with monitoring the particle size distribution of the toner particles precipitated by the centrifugal sedimentation. Such a simultaneous washing and classification operation was repeated so as to obtain a dispersion of the toner particles having the same particle size distribution.

The thus obtained toner particles were dried, so that a toner (q) according to the present invention was obtained.

EXAMPLE 18

The procedure for preparation of the toner (n) in Example 14 was repeated except that deionized water containing 1 wt. % of partially-saponified polyvinyl alcohol serving as the dispersion medium for the primary particles employed in Example 14 was replaced by deionized water containing 0.3 wt. % of sodium dodecylbenzenesulfonate, so that a toner (A) was prepared.

The supernatant liquid obtained after the centrifugal sedimentation in the course of the preparation of the above-mentioned toner (A) was collected. Thus, the dispersion of the extremely minute particles was obtained.

As gradually adding deionized water containing 0.3 wt. % of octyl trimethyl ammonium bromide to the above-mentioned dispersion, the extremely minute particles in the dispersion were aggregated. Thus, the particles with a desired particle size distribution were obtained in the dispersion.

This dispersion was heated, washed, and dried in the same manner as in Example 1, so that a toner (B) was prepared.

The previously obtained toner (A) and toner (B) were mixed, so that a toner (r) according to the present invention was obtained.

EXAMPLE 19

The primary particles were prepared and the thus prepared primary particles and hydrophobic silica were mixed in the same manner as in Example 1.

60 kg of deionized water containing 1 wt. % of partially-saponified polyvinyl alcohol was supplied to a 100-l tank through a pump, and 25 kg of the above-mentioned silica-deposited primary particles were supplied to the same tank through a feeder.

In the tank, the silica-deposited primary particles were dispersed in the aqueous solution of the polyvinyl alcohol with stirring.

The thus obtained dispersion in the tank was drawn into a pipe by a predetermined amount using a pump. This pipe had a heating zone where the pipe was heated from the outside, and a cooling zone where the pipe was cooled from the outside. While the dispersion was flowing through the pipe, the dispersion was first heated in a heating zone with passing at a speed of 5 l/min. One minute after the dispersion entered the heating zone, it was confirmed that the temperature of the dispersion was increased to 85° C., and the dispersion was flowing in the heating zone with the temperature thereof being maintained at 85° C. It took 10 minutes for the dispersion to pass through the heating zone.

After passing through the heating zone, the dispersion entered the cooling zone where the dispersion was cooled to 25° C.

Thereafter, the dispersion was caused to pass through a classification zone equipped with a hydro cyclone twice, so that extremely minute particles were removed from the dispersion.

The thus obtained slurry was continuously subjected to drying by using a spray dryer.

Thus, a toner (s) according to the present invention was obtained.

EXAMPLE 20

The primary particles were prepared in the same manner as in Example 1 except that air classification was not carried out after pulverization by the jet mill.

100 parts by weight of the primary particles not subjected to classification and 0.5 parts by weight of hydrophobic silica were mixed in a mixer.

In a container, 25 parts by weight of the silica-deposited primary particles were dispersed in 100 parts by weight of deionized water containing 0.3 wt. % of sodium dodecylbenzenesulfonate.

Then, 30 parts by weight of deionized water containing 0.3 wt. % of octyl trimethyl ammonium bromide were added dropwise to the above obtained dispersion with stirring. After the completion of the addition, it was observed by the optical microscope that only the extremely minute particles were aggregated in the dispersion.

Thereafter, the heating, cooling, washing and drying operations were carried out in the same manner as in Example 1.

Thus, a toner (t) according to the present invention was obtained.

Example 21

(Preparation of primary particles)

A mixture of the following components was kneaded and dispersed in a two-roll mill under the application of heat thereto:

| | Parts by Weight |
|---|---|
| Partially crosslinked styrene - n-butyl methacrylate - 2-ethylhexyl acrylate copolymer | 100 |
| Carbon black | 10 |
| Zinc t-butyl salicylate | 3 |
| Low-molecular weight polypropylene | 5 |

The thus prepared mixture was cooled and roughly crushed, pulverized in a jet mill, and then classified by air classification so as to remove extremely minute particles. Thus, primary particles were prepared.

100 parts by weight of the above prepared primary particles and 0.5 parts by weight of hydrophobic silica were mixed in a mixer.

In a pressurizing container equipped with a stirrer, 20 parts by weight of the silica-deposited primary particles were added to 100 parts by weight of deionized water containing 1 wt. % of polyethylene glycol with stirring, and the mixture was further stirred for 10 minutes. After the completion of stirring, it was confirmed by visual observation that the silica-deposited primary particles were completely wetted with the aqueous solution. Further, it was observed by the optical microscope that each of the silica-deposited primary particles was separately dispersed in the aqueous solution.

The container was put in an oil bath to heat the mixture in the container to 105° C. with stirring, and the internal temperature was maintained at 105° C. for 10 minutes. Thereafter, the mixture was cooled to 20° C.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried in an oven at 40° C. until a contrast weight was reached.

Thus, a toner (u) according to the present invention was obtained.

Comparative Example 1

A mixture of the following components was dispersed in a ball mil for 20 hours to prepare a dispersion:

| | Parts by Weight |
|---|---|
| Styrene | 70 |
| n-butyl methacrylate | 30 |
| Divinylbenzene | 0.5 |
| Carbon black | 10 |
| Low-molecular weight polypropylene | 5 |
| Zinc di-t-butyl salicylate | 3 |

One part by weight of 2,2-azobisisobutyronitrile was added to the above prepared dispersion with stirring, and dissolved therein.

The thus obtained mixture was put in a separable flask in which 300 parts by weight of an aqueous solution containing 1 wt. % of partially-saponified polyvinyl alcohol, and 9 parts by weight of tricalcium phosphate were placed. This mixture was dispersed to prepare a suspension using a homogenizer. Then, the suspension thus prepared was stirred at 70° C. in a stream of nitrogen, so that the polymerization was carried out for 20 hours.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried at 40° C. in a vacuum dryer for 24 hours until a constant weight was reached.

100 parts by weight of the thus obtained toner particles and 0.5 parts by weight of hydrophobic silica were mixed in a mixer, so that a comparative toner (1) was obtained.

Comparative Example 2

A mixture of the following components was dispersed in a ball mill for 20 hours:

| | Parts by Weight |
|---|---|
| Partially-crosslinked styrene - acrylic resin | 100 |
| Carbon black | 10 |
| Zinc di-t-butyl salicylate | 3 |

-continued

| | Parts by Weight |
|---|---|
| Low-molecular weight polypropylene | 5 |
| Methyl ethyl ketone | 200 |

The thus obtained dispersion was put in a separable flask in which 600 parts by weight of an aqueous solution containing 1 wt. % of partially-saponified polyvinyl alcohol and 18 parts by weight of tricalcium phosphate were placed. This mixture was dispersed to prepare a suspension using a homogenizer, and the methyl ethyl ketone was distilled away from the mixture under reduced pressure.

The thus obtained dispersion was subjected to centrifugal sedimentation, and then the resultant supernatant liquid was removed. The residue thus obtained was dispersed again in deionized water in the same amount of that of the removed supernatant liquid. Such a washing process was repeated three times. Finally, the dispersion was filtered off under reduced pressure, and the obtained product was dried at 40° C. in a vacuum dryer for 24 hours until a constant weight was reached.

100 parts by weight of the thus obtained toner particles and 0.5 parts by weight of hydrophobic silica were mixed in a mixer, so that a comparative toner (2) was obtained.

Comparative Example 3

A mixture of the following components was kneaded and dispersed in a two-roll mill under the application of heat thereto:

| | Parts by Weight |
|---|---|
| Partially-crosslinked styrene - n-butyl methacrylate copolymer | 100 |
| Carbon black | 10 |
| Zinc di-t-butyl salicylate | 3 |
| Low-molecular weight polypropylene | 5 |

The thus prepared mixture was cooled and roughly crushed, pulverized in a jet mill, and then classified by air classification so as to remove extremely minute particles.

100 parts by weight of the above obtained particles and 0.5 parts by weight of hydrophobic silica were mixed in a mixer, so that a comparative toner (3) was obtained.

Comparative Example 4

A mixture of the following components was kneaded and dispersed in a two-roll mill under the application of heat thereto:

| | Parts by Weight |
|---|---|
| Partially-crosslinked styrene - n-butyl methacrylate copolymer | 100 |
| Carbon black | 10 |
| Zinc di-t-butyl salicylate | 3 |

-continued

| | Parts by Weight |
|---|---|
| Low-molecular weight polypropylene | 5 |

The thus prepared mixture was cooled and roughly crushed, pulverized in a jet mill, and then classified by air classification so as to remove extremely minute particles. Thus, primary particles were prepared.

In a container, 25 parts by weight of the above-obtained primary particles were added to 100 parts by weight of deionized water containing 1 wt. % of partially-saponified polyvinyl alcohol with stirring, and the mixture was further stirred for 10 minutes.

The container was put in hot water to heat the mixture in the container to 85° C. with stirring. As soon as the mixture was heated to 85° C., the particles were aggregated. 10 minutes later, the aggregated particles became complete coalescence of the particles. As a result, a toner was not obtained.

Comparative Example 5

The primary particles were prepared in the same manner as in Example 1.

100 parts by weight of the above prepared primary particles and 0.5 parts by weight of hydrophobic silica were mixed in a mixer.

The thus prepared silica-deposited primary particles were added to 100 parts by weight of deionized water little by little. As a result, the silica-deposited primary particles were not dispersed in deionized water and stayed on the surface of deionized water. Thus, a toner was not obtained.

Comparative Example 6

The procedure for preparation of the toner (a) according to the present invention in Example 1 was repeated except that the dispersion of the silica-deposited primary particles was not stirred in the course of heating step.

Thus, a comparative toner (4) was obtained.

Comparative Example 7

The primary particles were prepared in the same manner as in Example 5.

100 parts by weight of the above prepared primary particles and 0.5 parts by weight of hydrophobic silica were mixed in a mixer, so that a comparative toner (5) was obtained.

Comparative Example 8

The primary particles were prepared in the same manner as in Example 7.

100 parts by weight of the above prepared primary particles and 0.8 parts by weight of hydrophobic silica were mixed in a mixer, so that a comparative toner (6) was obtained.

Each of the thus obtained toners was examined for the following items:

(1) Amount of volatile organic component in the toner particles:

It was measured by the previously mentioned method.

(2) Average spherical degree of toner particles:

It was measured by the previously mentioned method.

(3) Softening point of toner particles:

The measuring method is shown in that of the flow-initiating point to be described later.

(4) Flow-initiating point of toner particles:

Using a commercially available flow tester of capillary type (made by Shimadzu Corporation), a sample of each toner (about 1 $cm^3$) was put in a cylinder with a nozzle having a diameter of 0.5 mm and a length of 1 mm and heated under the conditions that a load of 10 $kg/cm^2$ was applied to a plunger and the temperature of the sample was increased by 3° C./min. With the increase of the temperature, the plunger was gradually descending to compress the toner sample in the cylinder. The temperature at which an air gap in the cylinder disappeared and the toner sample apparently assumed a uniform transparent state was regarded as the softening point of the toner.

When the toner sample assumed the uniform transparent state, there was no apparent change in the position of the plunger. Further increasing the temperature of the toner sample, the toner sample was extruded through the nozzle. The temperature at which the plunger started to descent again to extrude the sample through the nozzle was regarded as the flow-initiating point.

(5) Viscosity at temperature higher than flow-initiating point of toner by 10° C.:

It was measured by the previously mentioned method.

(6) Presence of void in toner particles:

It was observed by the previously mentioned method.

(7) Odor:

A sample of each toner was tightly sealed in a container and stored at 50° C. for 24 hours. Ten members were chosen at random for an organoleptic test. After the storage, the order of toner in the container was evaluated by the above-mentioned ten panelists on a scale from 1 to 3.

(Scale of odor)

1: There was no odor.

2: There was a slight odor.

3: There was a strong odor.

(8) Preservation stability at high temperature (Blocking resistance):

A sample of each toner was placed in a screw vial and stored at 50° C. for 24 hours. After the storage, the hardness of a surface portion of the toner sample was measured by dropping a needle on the toner sample. The hardness was expressed by the depth of penetration of the needle.

The harder the surface of the toner, the poorer the preservation stability at high temperature.

The results of the above evaluations are shown in Table 1.

TABLE 1

| | Volatile Organic Component (ppm) | Average Spherical Degree | Softening Point (° C.) | Flow-initiating Point (° C.) | Void | Melt Viscosity (*) (Pa · s) | Odor | Preservation Stability |
|---|---|---|---|---|---|---|---|---|
| Ex. 1 | 30 | 135 | 83 | 135 | none | 9500 | none | good |
| Ex. 2 | 30 | 135 | 83 | 130 | none | 9500 | none | good |
| Ex. 3 | 30 | 130 | 83 | 129 | none | 9500 | none | good |
| Ex. 4 | 25 | 115 | 82 | 128 | none | 9300 | none | good |
| Ex. 5 | 20 | 125 | 88 | 123 | none | 12000 | none | good |
| Ex. 6 | 30 | 135 | 83 | 130 | none | 9500 | none | good |
| Ex. 7 | 20 | 110 | 70 | 115 | none | 6500 | none | good |
| Ex. 8 | 15 | 113 | 70 | 90 | none | 6000 | none | good |
| Ex. 9 | 30 | 108 | 75 | 100 | none | 4000 | none | good |
| Ex. 10 | 36 | 145 | 84 | 131 | none | 9700 | none | good |
| Ex. 11 | 30 | 105 | 84 | 131 | none | 9700 | none | good |
| Ex. 12 | 35 | 136 | 80 | 128 | none | 9000 | none | good |
| Ex. 13 | 34 | 134 | 81 | 129 | none | 9200 | none | good |
| Ex. 14 | 40 | 131 | 82 | 129 | none | 9800 | none | good |
| Ex. 15 | 38 | 128 | 82 | 129 | none | 9800 | none | good |
| Ex. 16 | 41 | 140 | 80 | 130 | none | 9000 | none | good |
| Ex. 17 | 40 | 135 | 82 | 131 | none | 8200 | none | good |
| Ex. 18 | 39 | 131 | 79 | 129 | none | 8900 | none | good |
| Ex. 19 | 31 | 140 | 83 | 130 | none | 9500 | none | good |
| Ex. 20 | 29 | 134 | 82 | 131 | none | 9400 | none | good |
| Ex. 21 | 15 | 118 | 95 | 145 | none | 10200 | none | good |
| Comp. Ex. 1 | 2500 | 103 | 80 | 130 | none | 9000 | strong | very poor |
| Comp. Ex. 2 | 5100 | 101 | 85 | 132 | many | 9100 | strong | very poor |
| Comp. Ex. 3 | 60 | 240 | 84 | 130 | none | 9500 | slight | slightly poor |
| Comp. Ex. 4 | — | — | — | — | — | — | — | — |
| Comp. Ex. 5 | — | — | — | — | — | — | — | — |
| Comp. Ex. 6 | — | — | — | — | — | — | — | — |
| Comp. Ex. 7 | 70 | 240 | 90 | 123 | none | 13000 | slight | slightly poor |
| Comp. Ex. 8 | 30 | 205 | 70 | 115 | none | 6500 | slight | slightly poor |

(*) Melt Viscosity was measured at a temperature higher than the flow-initiating point of the toner particles by 10° C.

Using each of the toners, image formation test was carried out on 10,000 sheets.

In the image formation test, the magnetic toner (e) obtained in Example 5 was supplied to a commercially available copying machine "IMAGIO MF150" (Trademark); the color toners (g), (h) and (i) respectively obtained in Examples 7, 8 and 9 were supplied to a commercially available color copying machine "PRETER 550" (Trademark); and the rest toners were supplied to a commercially available copying machine "IMAGIO DA250" (Trademark). The above-mentioned copying machines are made by Ricoh Company, Ltd.

Further, ferrite particles with a particle size of 100 $\mu$m were coated with a silicone resin, followed by crosslinking, so that those silicone-resin-coated ferrite particles were prepared as the carrier particles. Each toner except the magnetic toner (e) was used in combination with the above-prepared carrier.

Through the image formation test, the following evaluations were carried out:

(1) Image transfer ratio:

To obtain the image transfer ratio of each toner, after the toner images were formed on a photoconductor or an intermediate image transfer member of the copying machine, the copying machine was stopped. Then, the photoconductor or the intermediate image transfer member was taken out of the copying machine to sample the toner from the surface of the photoconductor or the intermediate image transfer member by use of an adhesive tape. Namely, the amount of toner deposited on the surface of the photoconductor or the intermediate image transfer member was obtained before the image transfer (after development). Then, the remaining toner was sampled from the surface of the photoconductor or the intermediate image transfer member by use of the adhesive tape after the image transfer in the same manner as mentioned above.

The image transfer ratio was determined in accordance with the following formula:

$$\text{Image Transfer Ratio (\%)} = \left[1 - \frac{\text{(Amount of toner remaining on photoconductor after image transfer)}}{\text{(Amount of toner deposited on photoconductor before image transfer)}}\right] \times 100$$

(2) Partial omission in the obtained images:

After image formation, the obtained toner images were visually observed, and evaluated on a scale from 1 to 5 in comparison with the reference samples.

In this case, the larger the value of scale, the less the partial omission of toner image, and the toner with the scale 1 or 2 was not acceptable for the practical use.

(3) Damage of photoconductor:

After the image formation test, the photoconductor was taken out of the copying machine, and the surface of the photoconductor was observed by an electron microscope.

(4) Toner deposition on background:

A background portion in a toner-image-bearing sheet was observed by both of the naked eye and a magnifier to examine the deposition of the toner on the background portion after copying of 100 sheets, 4,000 sheets and 8,000 sheets.

(5) Contamination of carrier with charge control agent:

It was observed by use of an infrared spectrometer whether the charge control agent was sticking to the surface of the carrier particles or not.

The results are shown in Table 2.

TABLE 2

| | Image Transfer Ratio (%) | Partial Omission (non-transferred portion) | Damage of Photoconductor | Toner Deposition on Background | Contamination of Carrier |
|---|---|---|---|---|---|
| Ex. 1 | 95 | 3 | none | After copying of 8,000 sheets | slight |
| Ex. 2 | 96 | 3 | slight | After copying of 8,000 sheets | slight |
| Ex. 3 | 95 | 4 | none | After copying of 8,000 sheets | none |
| Ex. 4 | 100 | 5 | none | After copying of 8,000 sheets | none |
| Ex. 5 | 98 | 5 | none | After copying of 8,000 sheets | none |
| Ex. 6 | 97 | 4 | none | After copying of 8,000 sheets | none |
| Ex. 7 | 96 | 5 | none | not occurred | none |
| Ex. 8 | 98 | 5 | none | After copying of 8,000 sheets | none |
| Ex. 9 | 99 | 5 | none | After copying of 8,000 sheets | none |
| Ex. 10 | 90 | 4 | none | After copying of 4,000 sheets | none |
| Ex. 11 | 99 | 5 | none | After copying of 8,000 sheets | none |
| Ex. 12 | 98 | 4 | none | not occurred | none |
| Ex. 13 | 99 | 4 | none | not occurred | none |
| Ex. 14 | 98 | 4 | none | After copying of 8,000 sheets | slight |
| Ex. 15 | 99 | 4 | none | After copying of 8,000 sheets | slight |
| Ex. 16 | 95 | 4 | none | After copying of 8,000 sheets | slight |
| Ex. 17 | 96 | 4 | none | After copying of 8,000 sheets | slight |

TABLE 2-continued

| | Image Transfer Ratio (%) | Partial Omission (non-transferred portion) | Damage of Photoconductor | Toner Deposition on Background | Contamination of Carrier |
|---|---|---|---|---|---|
| Ex. 18 | 98 | 4 | none | After copying of 8,000 sheets | slight |
| Ex. 19 | 97 | 4 | none | After copying of 8,000 sheets | slight |
| Ex. 20 | 95 | 4 | none | After copying of 8,000 sheets | slight |
| Ex. 21 | 99 | 5 | none | not occurred | none |
| Comp. Ex. 1 | 96 | 5 | noticeable | After copying of 100 sheets | noticeable |
| Comp. Ex. 2 | 94 | 5 | noticeable | After copying of 100 sheets | noticeable |
| Comp. Ex. 3 | 82 | 5 | noticeable | After copying of 4,000 sheets | noticeable |
| Comp. Ex. 4 | — | — | — | — | — |
| Comp. Ex. 5 | — | — | — | — | — |
| Comp. Ex. 6 | — | — | — | — | — |
| Comp. Ex. 7 | 81 | 1 | significant | After copying of 4,000 sheets | slight |
| Comp. Ex. 8 | 82 | 1 | noticeable | After copying of 4,000 sheets | slight |

As previously explained, the toner of the present invention is free from odor and shows excellent preservation stability. In addition, when the toner image is formed using the toner of the present invention, the image transfer ratio is high and clear toner image can be formed without any partial omission.

Japanese Patent Application No. 8-240428 filed Sep. 11, 1996 and Japanese Patent Application filed Sep. 10, 1997 are hereby incorporated by reference.

What is claimed is:

1. A toner for use in electrophotography comprising toner particles, each toner particle comprising a resin, a colorant, a fluidity-imparting agent and a volatile organic component which is in an amount of 100 ppm or less per unit amount of said toner particles, and having an average spherical degree in a range of 100 to 150, which is calculated from a spherical degree (SD) of each toner particle defined by formula (I):

$$SD=25\pi L^2/S \quad \text{(I)}$$

where L is a maximum length of a projected cross-sectional image of each toner particle, and S is an area of the projected cross-sectional image of each toner particle, wherein said toner particles have a softening point of 50° C. or more and a flow-initiating point of 110° C. or less.

2. The toner as claimed in claim 1, wherein said fluidity-imparting agent is present only on the surface of said toner particles.

3. The toner as claimed in claim 1, further comprising a charge control agent which is deposited on the surface of said toner particles.

4. The toner as claimed in claim 1, wherein said toner particles have a melt viscosity of 5000 Pa.s or less when heated to a temperature higher than the flow-initiating point of said toner particles by 10° C.

5. The toner as claimed in claim 1, wherein said resin comprises at least one resin component selected from the group consisting of polyester resin, polyol resin and epoxy resin.

6. The toner as claimed in claim 1, wherein said toner particles have a flow-initiating point of 100° C. or less.

7. A method of producing toner particles, each toner particle comprising a resin, a colorant, a fluidity-imparting agent and a volatile organic component which is an amount of 100 ppm or less per unit amount of said toner particles, and having an average spherical degree in a range of 100 to 150, which is calculated from a spherical degree (SD) of each toner particle defined by formula (I):

$$SD=25\pi L^2/S \quad \text{(I)}$$

wherein L is a maximum length of a projected cross-sectional image of each toner particle, and S is an area of the projected cross-sectional image of each toner particle, wherein said toner particles have a softening point of 50° C. or more and a flow-initiating point of 110° C. or less, the method comprising:

preparing primary particles, each particle comprising a resin and a colorant, depositing a fluidity-imparting agent on the surface of said primary particles, dispersing said fluidity-imparting agent deposited primary aprticles in a liquid comprising a dispersant, in which liquid said resin is insoluble, thereby preparing dispersion of said primary particles, heating said dispersion with stirring, and cooling said dispersion, thereby obtaining said toner particles.

8. The toner as claimed in claim 7, further comprising a step of classifying said toner particles with a predetermined particle size distribution, a step of washing said toner particles, and a step of drying said toner particles, which steps were carried out after said cooling step.

9. The toner as claimed in claim 7, wherein said dispersion is heated to a temperature near the softening point of said primary particles in said heating step.

10. The method as claimed in claim 7, wherein a charge control agent is added to said resin and said colorant in said step of preparing said primary particles.

11. The method as claimed in claim 7, further comprising a step of adding a charge control agent to said dispersion together with a liquid in which said resin is soluble or in which said resin swells after said step of heating said dispersion or said step of cooling said dispersion.

12. The method as claimed in claim 7, wherein said step of heating said dispersion is carried out under application of pressure thereto.

* * * * *

UNITED STATES PATENT AND TRADEMARK OFFICE

CERTIFICATE OF CORRECTION

PATENT NO. : 6,329,115 B1
DATED : December 11, 2001
INVENTOR(S) : Hiroshi Yamashita It is certified that error appears in the above-identified patent and that said Letters Patent is hereby corrected as shown below:

Column 2,
Line 27, delete "porimerized" and insert -- polymerized --.

Column 3,
Line 22, delete "unsatisfactory" and insert -- satisfactory --.

Column 6,
Line 51, delete "Hewkett" and insert -- Hewlett --.

Column 8,
Line 45, delete "divided divided" and insert -- divided --;
Line 67, delete "commercially available product".

Column 9,
Line 3, delete "Bontron p-51" and insert -- Bontron P-51 --.

Column 11,
Line 2, delete "are" and insert -- do --;
Line 46, delete "monoperfluoroaklyl" and insert -- monoperfluoroalkyl --;
Line 55, delete "EETOP" and insert -- EFTOP --.

Column 15,
Line 39, delete "hating" and insert -- heating --.

Column 21,
Line 56, delete "weigh" and insert -- weight --.

Column 24,
Line 6, delete "same" and insert -- desired --.

Column 29,
Line 22, delete "descent" and insert -- descend --.

Column 30,
Line 10, delete "order" and insert -- odor --.

Column 31,
Line 9, should read -- (Trademark); and the rest of the toners were supplied to a com- --.

UNITED STATES PATENT AND TRADEMARK OFFICE

CERTIFICATE OF CORRECTION

PATENT NO. : 6,329,115 B1
DATED : December 11, 2001
INVENTOR(S) : Hiroshi Yamashita It is certified that error appears in the above-identified patent and that said Letters Patent is hereby corrected as shown below:

Column 34,
Line 32, should read -- agent and a volatile organic component which is in an amount --;
Line 51, delete "aprticles" and insert -- particles --.

Signed and Sealed this

Seventh Day of May, 2002

*Attest:*

*Attesting Officer*

JAMES E. ROGAN
*Director of the United States Patent and Trademark Office*